US008136191B2

(12) United States Patent
Jorkama-Lopez et al.

(10) Patent No.: US 8,136,191 B2
(45) Date of Patent: Mar. 20, 2012

(54) SCAFFOLD ARRANGEMENT AND METHOD FOR REPAIRING THE EDGE STRUCTURE OF A CONCRETE BRIDGE

(75) Inventors: Tomas Alberto Jorkama-Lopez, Provoo (FI); Hannu Ojantausta, Espoo (FI)

(73) Assignee: Moldtech Oy, Espoo (FI)

( * ) Notice: Subject to any disclaimer, the term of this patent is extended or adjusted under 35 U.S.C. 154(b) by 82 days.

(21) Appl. No.: 12/597,622

(22) PCT Filed: Apr. 24, 2008

(86) PCT No.: PCT/FI2008/050221
§ 371 (c)(1),
(2), (4) Date: Mar. 14, 2010

(87) PCT Pub. No.: WO2008/132277
PCT Pub. Date: Nov. 6, 2008

(65) Prior Publication Data

US 2010/0175205 A1 Jul. 15, 2010

(30) Foreign Application Priority Data

Apr. 27, 2007 (FI) ..... 20070334

(51) Int. Cl.
*E01D 22/00* (2006.01)

(52) U.S. Cl. ..... 14/78; 14/77.1; 182/150

(58) Field of Classification Search ..... 14/77.1, 14/78

See application file for complete search history.

(56) References Cited

U.S. PATENT DOCUMENTS

| | | | | |
|---|---|---|---|---|
| 3,985,480 | A * | 10/1976 | Finsterwalder | 425/63 |
| 4,260,126 | A * | 4/1981 | Schreck et al. | 249/20 |
| 4,453,619 | A * | 6/1984 | Bierman | 182/142 |
| 4,660,800 | A * | 4/1987 | Horstketter | 249/24 |
| 5,549,176 | A * | 8/1996 | Hawkins | 182/63.1 |
| 2011/0067955 | A1 * | 3/2011 | Jorkama-Lopez et al. | 182/150 |

* cited by examiner

FOREIGN PATENT DOCUMENTS

| | | | |
|---|---|---|---|
| DE | 19922005 | A1 | 11/2000 |
| JP | 5044202 | A | 2/1993 |
| JP | 2005171703 | A | 6/2005 |

OTHER PUBLICATIONS

International Search Report for PCT/FI2008/050221 mailed Aug. 1, 2008.

*Primary Examiner* — Raymond W Addie
(74) *Attorney, Agent, or Firm* — Potomac Patent Group PLLC

(57) ABSTRACT

A scaffold arrangement for repairing the edge structure of a concrete bridge. A steel-structured bent comprises a vertical beam that can be anchored by support members to the upper surface of the bridge. The vertical beam extends to a distance above the upper surface of the bridge. An upper horizontal beam is rigidly secured to the upper end of the vertical beam and the horizontal beam extends substantially transversely relative to the longitudinal direction of the bridge and over the edge of the bridge. A vertical column is secured to the end of the upper horizontal beam. The lower end of the vertical column extends down from the edge of the bridge. A lower horizontal beam is secured to the vertical column and extends in alignment with the upper horizontal beam. The lower horizontal beam comprises a first beam portion extending from the vertical column to a distance below the bridge so that mold walls can be fitted onto the first beam portion, and a second beam portion extending from the vertical column to an opposite direction relative to the first beam portion and supporting an access bridge. A longitudinally adjustable support bar is pivotally connected at one end to the first beam portion and at the other end is supportable against the lower surface of the bridge.

19 Claims, 7 Drawing Sheets

Figure 1:
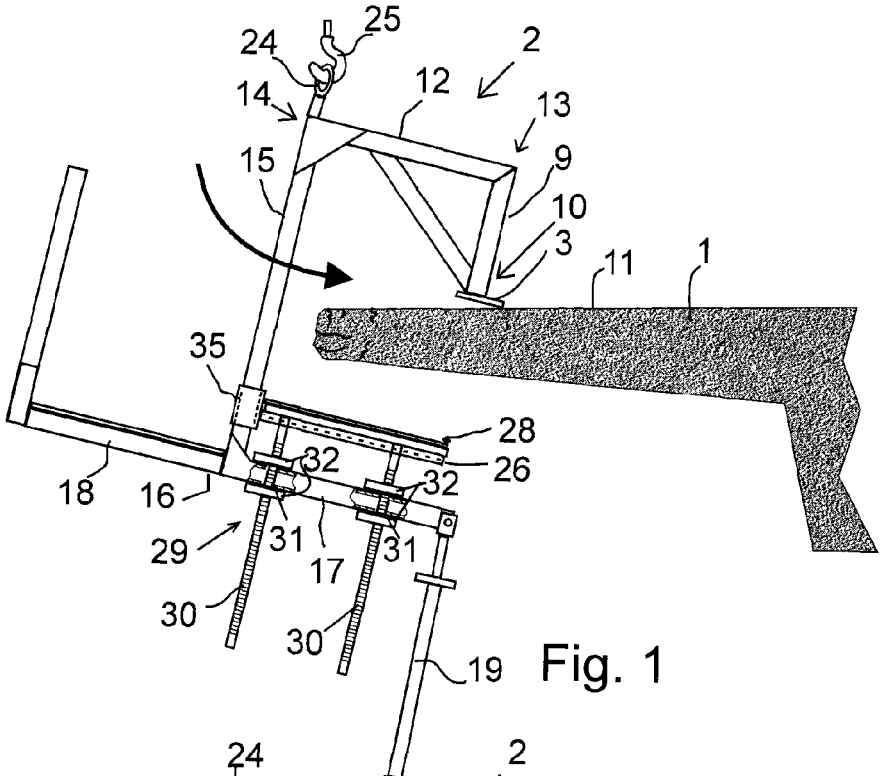

SCAFFOLD ARRANGEMENT AND METHOD FOR REPAIRING THE EDGE STRUCTURE OF A CONCRETE BRIDGE

RELATED APPLICATIONS

This application claims priority and benefit from International Application No. PCT/FI2008/050221, filed Apr. 24, 2008, which claims priority to Finnish Patent Application No. 20070334, filed Apr. 27, 2007, the entire teachings of which are incorporated herein by reference.

FIELD OF THE INVENTION

The invention relates to the scaffold arrangement as defined in the preamble of claim 1. The invention also relates to the method defined in the preamble of claim 15.

BACKGROUND OF THE INVENTION

The edge structure, such as the edge beam, of a concrete bridge is susceptible to damage over time e.g. due to disintegration of the concrete, providing a need to repair the edge structure.

In Finland, bridges are administered by e.g. Finnish Road Administration, disclosing the known methods and scaffold arrangements in their instructions concerning bridge repair (SILKO), and specifically in the SILKO instructions Betonirakenteet, Reunapalkin uusiminen, 2.211, 1/92 (http://alk.tiehallinto.fi/sillat/silko/kansio2/s2211.pdf) concerning concrete structures and the renewal of an edge beam.

The closest prior art is represented by a scaffold arrangement comprising a casting mould and an access bridge supported onto the same scaffold that is suspended from the edge of the bridge. The arrangement comprises a number of bents arranged at a distance from each other for the length of the area of the bridge that needs repairing and supported onto the edge of the bridge by support members. The access bridge is supported onto the bents in order to form a passage for the duration of the repair period. Mould walls are supported onto the bents in order to form a concrete casting mould for casting the new edge structure for the bridge.

The problem with all known scaffold arrangements is that in order to provide a sufficiently tight mounting, the mounting of the scaffold has required the formation of holes extending through the entire deck of the bridge. In other words, the bents have been suspended by the bars extending through the above-mentioned holes. To mount such scaffolds, the mounters have been forced to work for extended periods from underneath the bridge, by means of e.g. a passenger lift or, if possible, a so-called bridge crane positioned onto the deck. Long-term work on/under the bridge with lifting machines disturbs road traffic and often also railway traffic. Moreover, the mounting is difficult in bridges which cross waterways. With the known methods and arrangements, for example the construction of a scaffold arrangement required for repairing the edge beam of a bridge has taken a long time. Long mounting and repair periods hinder the traffic and increase the expenses. Furthermore, the present scaffolds are usually made from timber, so that the scaffolds are disassembled after the work is completed, and only a portion of the stouter timber may be reused, the rest ending up on a landfill site as unserviceable.

OBJECTIVE OF THE INVENTION

The objective of the invention is to eliminate the drawbacks referred to above.

One specific objective of the invention is to disclose an arrangement which can be mounted so that as short working period as possible from underneath the bridge is required.

A further objective of the invention is to disclose a method and an arrangement which enable a considerably faster repair of the edge structure of a bridge compared to the present situation.

Another objective of the invention is to disclose an arrangement which can be used repeatedly several times in different locations and which can be adapted and adjusted to be suitable for almost all existing bridges.

SUMMARY OF THE INVENTION

The arrangement and method according to the invention are characterized by what has been presented in the accompanying claims.

According to the invention, the bent comprises a vertical steel beam which is substantially vertical and in which vertical beam the lower end can be anchored by support members to the upper surface of the bridge at a distance from the edge of the bridge that needs repairing, the vertical beam extending to a distance above the upper surface of the bridge. The bent further comprises an upper horizontal steel beam in which the first end is rigidly secured to the upper end of the vertical beam and which horizontal beam extends from the vertical beam substantially horizontally and substantially transversely relative to the longitudinal direction of the bridge in such manner that the second end of the upper horizontal beam extends over the edge of the bridge to a distance from the edge of the bridge. The bent also comprises a vertical steel column, secured vertically at the upper end to the second end of the upper horizontal beam, the lower end of the vertical column extending to a distance down from the edge of the bridge. The bent further comprises a lower horizontal steel beam which is rigidly secured to the vertical column and extends from the vertical column substantially horizontally and substantially transversely relative to the longitudinal direction of the bridge. The lower horizontal beam comprises a first beam portion extending from the vertical column to a distance below the bridge, so that said mould walls can be fitted onto the first beam portion. The lower horizontal beam further comprises a second beam portion extending from the vertical column to an opposite direction relative to the first beam portion and supporting the access bridge. A longitudinally adjustable support bar is pivotally connected at one end to the first beam portion and at the other end is supportable against the lower surface of the bridge.

In the method, the lower ends of the vertical beams of the bents are fixedly anchored according to the invention by the support members to the upper surface of the bridge at a distance from the edge of the bridge that needs repairing.

The invention provides the advantage that the scaffold arrangement can be mounted by working from the top of the bridge, which reduces considerably the time required for the repair work. The scaffold arrangement is quickly mounted and disassembled, saving costs and reducing the traffic disturbance. The scaffold arrangement is safe for those trafficking below. There is no disturbance for the traffic below the bridge. There is no need to drill thorough holes into the deck of the bridge that would later have to be patched up. Being steel-structured, the arrangement is strong and it can be used repeatedly several times all over again in different locations and be adapted and adjusted to be suitable for almost all existing bridges.

In one embodiment of the arrangement, the scaffold arrangement comprises at least two bents at a distance from each other. Access bridge element and mould wall elements can be supported onto the bents.

In one embodiment of the arrangement, a mounting flange is rigidly secured to the lower end of the vertical beam. The mounting flange comprises long holes which extend substantially transversely relative to the longitudinal direction of the bridge. Anchor bolts can be secured through the long holes to the bridge.

In one embodiment of the arrangement, the bent comprises a suspension member which can be grabbed. The suspension member is arranged to be offset from the mass centre of the bent so that when lifted by the suspension members, the bents are tilted in such manner that during mounting of the bents, the mounting flange is first supported at the edge to the upper surface of the bridge at a contact point, and when the bent is lowered further the mounting flange turns about said contact point, until it is in alignment with the upper surface and rests against it.

In one embodiment of the arrangement, each bent comprises a holder in which the level can be adjusted vertically and onto which mould walls can be supported.

In one embodiment of the arrangement, the arrangement comprises a receiving member for receiving the rubble removed from the edge of the bridge. The receiving member can be supported onto the holders.

In one embodiment of the arrangement, the holder is guided to move vertically in the guidance of the vertical column.

In one embodiment of the arrangement, the holder comprises an adjustment member for moving the mould walls horizontally.

In one embodiment of the arrangement, the bent comprises a lifting device arranged to operate between the holder and the first beam portion in order to adjust the level of the holder.

In one embodiment of the arrangement, the lifting device comprises a lifting screw, wherein the holder is arranged onto the upper end of the lifting screw and the lifting screw extends through a hole in the first beam portion. Locking nuts are arranged into the first beam portion in order to lock the lifting screw.

In one embodiment of the arrangement, the lifting device is a mechanical or hydraulic jack.

In one embodiment of the arrangement, the mould walls comprise at least one horizontal mould wall which limits the casting in a downward direction and at least one vertical mould wall which limits the casting in a lateral direction.

In one embodiment of the arrangement, the vertical mould walls comprise a first vertical mould wall for limiting the casting in a first lateral direction, and a second vertical mould wall for limiting the casting in a second lateral direction which is an opposite direction relative to the first lateral direction.

In one embodiment of the arrangement, the bent comprises a vertical support connected to the upper horizontal beam at a distance from the vertical beam.

In one embodiment of the arrangement, the vertical support is adapted to operate as a supporting foot for the bent during mounting.

In one embodiment of the arrangement, the vertical support is rigidly secured to the upper horizontal beam.

In one embodiment of the arrangement, the vertical support is adapted to move horizontally in the guidance of the upper horizontal beam, and it comprises locking members for detachably locking it to its position.

In one embodiment of the arrangement, the second vertical mould wall is connected to the vertical support.

In one embodiment of the method, the bent is moved to its position to the edge of the bridge that needs repairing by lifting it in a tilted position by the suspension members in such manner that the edge of the bridge is set between the mounting flanges and the holders. Then the tilted bent is lowered so that the mounting flange contacts the upper surface of the bridge. The bent is lowered further so that the mounting flange becomes aligned with the upper surface of the bridge. The mounting flange is secured to the upper surface of the bridge by the anchor bolts. The bent is supported onto the lower surface of the bridge by the longitudinally adjustable support bars.

In one embodiment of the method, when the mounting flange is being secured to the upper surface of the bridge, the position of the bent is adjusted by placing wedges between the mounting flange and the upper surface of the bridge.

In one embodiment of the method, a receiving member is arranged onto the holders for receiving the rubble. The holders and the receiving member are lifted by the lifting device in such manner that the receiving member comes close to the edge of the bridge that needs repairing. After that, old concrete is removed from the area to be renewed at the edge of the bridge and the rubble is received onto the receiving member. The rubble is removed from the receiving member and it is carried away along the access bridge.

In one embodiment of the method, the horizontal mould wall and the first vertical mould wall are supported onto the holders, and, optionally, the second vertical mould wall is supported onto the vertical support. The edge of the horizontal mould wall is placed tightly against the lower surface of the bridge. The first vertical mould wall is supported against the vertical columns and, at the lower end, tightly against the horizontal mould wall and it is moved horizontally to a distance from the remaining edge of the bridge after the removal of the old concrete. Optionally, the vertical support is adjusted horizontally, if such adjusting possibility is arranged, in order to position the second vertical mould wall, and is locked to its position by the locking members. A new edge beam or other edge extension is cast from concrete into the space bounded by the first vertical mould wall, the horizontal mould wall, the optional second vertical mould wall and the remaining edge of the bridge after the removal of the old concrete.

In one embodiment of the method, the holders are lowered by the lifting device after hardening of the cast concrete in order to remove the horizontal mould wall from the cast edge beam or other extension. The support bars are loosened. The anchor bolts are loosened so that the mounting flange can be moved horizontally relative to the upper surface of the bridge. Optionally, the second vertical mould wall is moved away from the cast edge beam etc. by moving the vertical support. The bents are moved transversely relative to the longitudinal direction of the bridge within the limits set by the long holes of the mounting flange in order to remove the first vertical mould wall from the cast edge beam or other extension.

In one embodiment of the method, the vertical mould walls are removed. Then the holders are lowered by the lifting device and the horizontal mould wall is removed from the holders. The access bridge is removed from the bents. The support members, such as the anchor bolts, are removed.

Finally, the bents are moved away from the edge of the repaired bridge by grabbing the suspension members and lifting the bents away from the edge of the bridge.

LIST OF FIGURES

Figure 2:
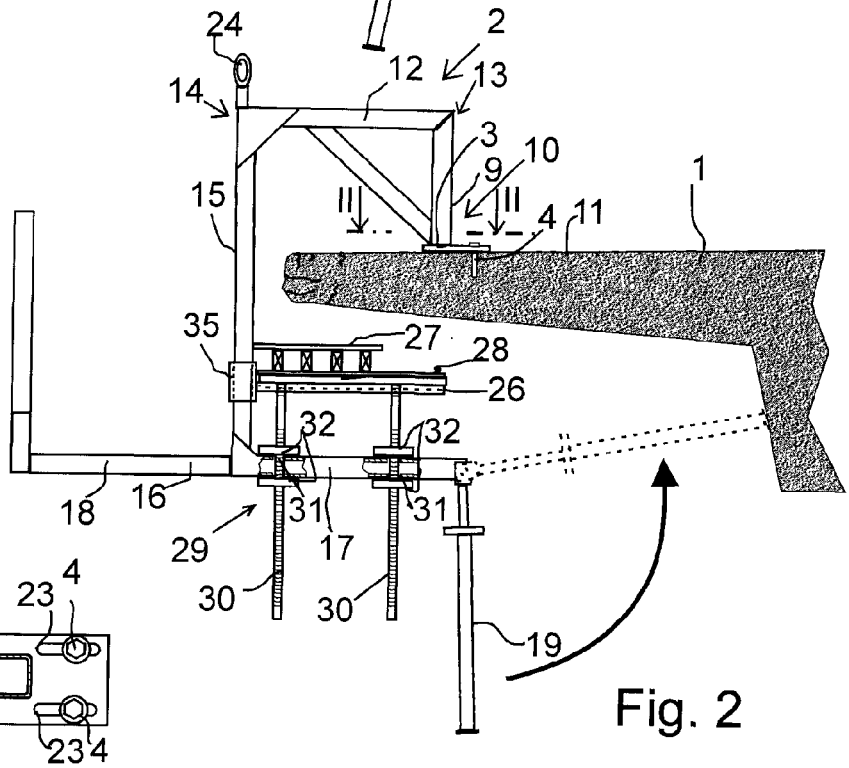
Figure 2A:
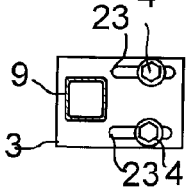
Figure 8:
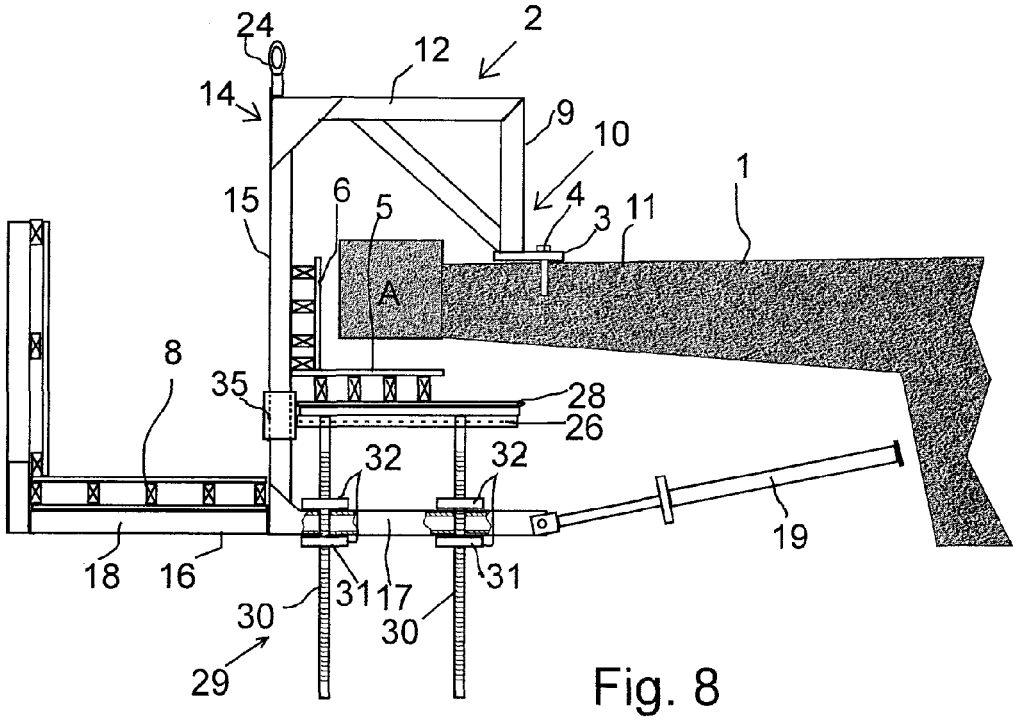
Figure 9:
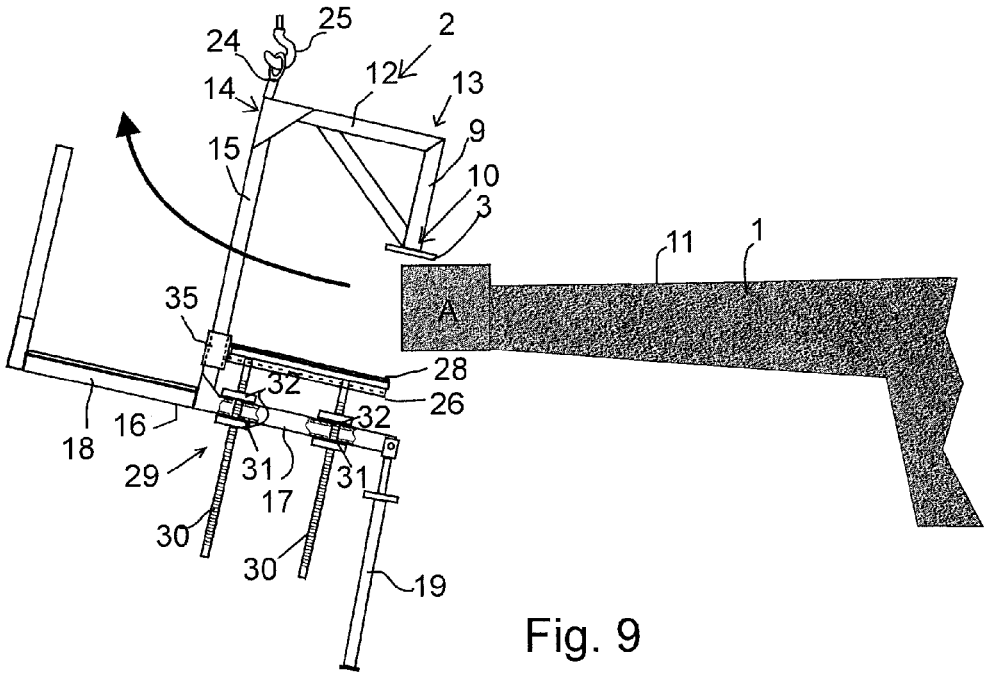
Figure 10:
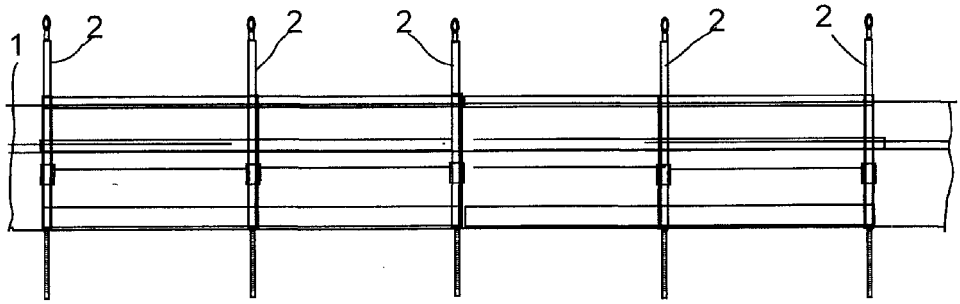
Figure 11:
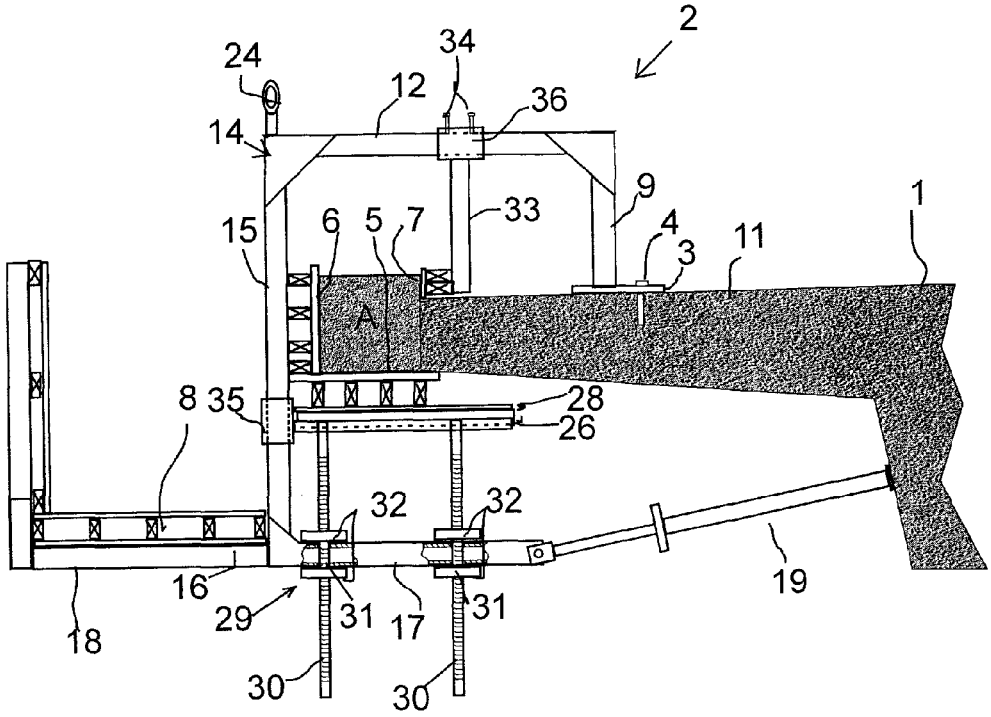
Figure 12:
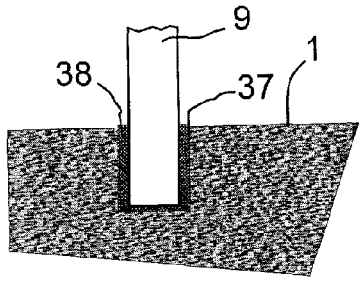
Figure 13:
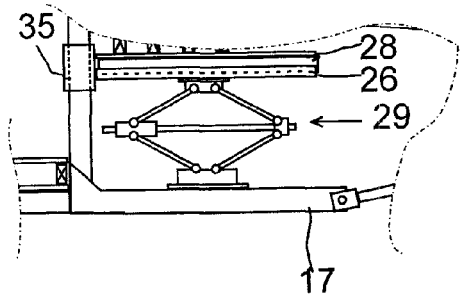
Figure 14:
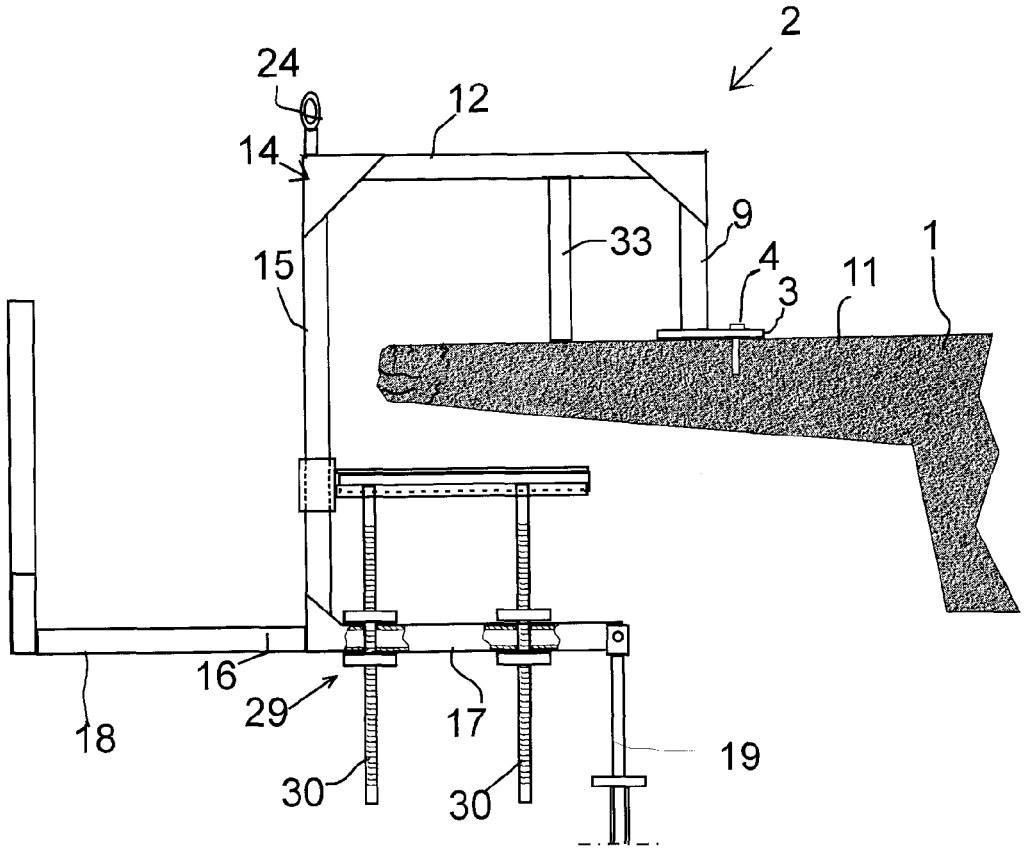

In the following section, the invention will be described in detail by means of exemplifying embodiments with reference to the accompanying drawing in which FIGS. 1-9 show a first embodiment of the arrangement according to the invention at different steps of the method according to the invention, FIG. 2*a* shows section II-II of FIG. 2, FIG. 10 shows schematically the adjacent bents of the arrangement of FIGS. 1-9, mounted successively to the edge of the bridge, as seen from the side of the bridge, FIG. 11 shows a second embodiment of the arrangement according to the invention at one step of the method, FIG. 12 shows a detail of an alternative securing of the lower end of the vertical beam of the bent to the deck of the bridge, FIG. 13 shows an alternative lifting device, and FIG. 14 shows a third embodiment of the arrangement according to the invention at a step of the method that corresponds to FIG. 2.

DETAILED DESCRIPTION OF THE INVENTION

FIGS. 1-10 show the scaffold arrangement to be mounted on the upper surface of a concrete bridge in order to repair a concrete edge structure of the bridge. FIGS. 1-9 show the bridge in cross-section.

As seen from the side view 10, in the arrangement a number of bents 2 are arranged at a distance from each other along the length of the portion of the bridge that needs to be repaired. For example when renewing the edge beam of the bridge or broadening the deck of the bridge, the scaffold arrangement is usually constructed to extend over the entire length of the bridge.

FIGS. 1-9 show one bent 2. All bents 2 in the arrangement are identical.

The bents 2 are supported by support members 3, 4 onto the upper surface close to the edge of the bridge, as will be described below. Mould walls 5, 6, 7 can be supported onto the bents 2 to form a concrete casting mould for casting a new edge structure for the bridge. The scaffold arrangement also comprises an access bridge 8 supported onto the bents 2 in order to form a passage and a working platform for the duration of the repair period.

The bent 2 comprises in a vertical direction a vertical steel beam 9 in which the lower end 10 can be anchored by the support members 3, 4 to the upper surface 11 of the bridge at a distance from the edge of the bridge that needs to be repaired. The vertical beam 9 extends to a distance above the upper surface 11 of the bridge. The first end 13 of an upper horizontal steel beam 12 is rigidly secured to the upper end of the vertical beam 9. The upper horizontal beam 12 extends from the vertical beam 9 horizontally and substantially transversely relative to the longitudinal direction of the bridge in such manner that the second end 14 of the upper horizontal beam 12 extends over the edge of the bridge to a distance from the edge of the bridge. A vertical steel column 15 is vertically secured at the upper end to the second end of the upper horizontal beam 12. The lower end of the vertical column extends to a distance down from the edge of the bridge. A lower horizontal steel beam 16 is secured rigidly to the vertical column 15 and extends from the vertical column 15 horizontally and substantially transversely relative to the longitudinal direction of the bridge. The lower horizontal beam 16 comprises a first beam portion 17 extending from the vertical column 15 to a distance below the bridge. Said mould walls 5, 6 can be fitted onto the first beam portion 17. A second beam portion 18 of the lower horizontal beam 16 extends from the vertical column 15 to an opposite direction relative to the first beam portion 17. The access bridge 8 is supported onto the second beam portion 18. A longitudinally adjustable support bar 19 is pivotally connected at one end to the first beam portion 17 and at the other end is supportable against the lower surface of the bridge. A flange positioned against the lower surface of the bridge may be connected by joints to the support bar 19.

In one preferred embodiment, the bents 2 are spaced at intervals of two metres and the access bridge 8 preferably comprises a prefabricated structure, so that for example 4 or 6 metres long access bridge elements 8 can be used, and, correspondingly, the mould walls 5, 6, 7 are preferably mould wall elements having the length of preferably 2 or 4 metres. These can be placed onto the bents, while the ribs are positioned in a staggered configuration.

A mounting flange 3 is rigidly secured to the lower end of the vertical beam 9 and is shown from the top in FIG. 2*a*. The mounting flange 3 comprises long holes 23 extending substantially transversely relative to the longitudinal direction of the bridge. Anchor bolts 4 can be secured to the bridge through the long holes 23.

Connected to the bent 2 is a suspension member 24 which in this context is a staple which can be grabbed by a grabbing member 25 of a lifting device, such as the lifting hook in FIG. 1. The suspension member 24 is slightly offset from the mass centre of the bent 2, so that when lifted by the suspension members 24, the bents 2 are tilted as shown in FIG. 1, so that during mounting of the bent 2, the mounting flange 3 is first supported at the edge onto the upper surface 11 of the bridge at a contact point, and when the bent 2 is lowered further, the mounting flange 3 turns about the above-mentioned contact point until it is aligned with the upper surface 11 and rests against it.

Each bent 2 comprises a holder 26, vertically moveable by the lifting device 29 and in the guidance of the vertical column 15, for supporting the mould walls 5, 6 or a receiving member 27 for the rubble. The end of the holder 26 on the side of the vertical column accommodates a first sliding sleeve 35 which cooperates with the outer surface of the vertical column 15 in order to guide the movement of the holder 26 in a vertical direction.

The receiving member 27 supported onto the holders 26 is able to receive the rubble removed from the edge of the bridge. The receiving member 27 may be a rigid planar body or a flexible piece of tarpaulin cloth. Also the horizontal mould wall 5 supported onto the holders 26 can in principle be applied as the receiving member 27. The holder 26 also comprises an adjustment member 28 for moving the mould walls 5, 6 horizontally. The holder 26 may be a U-shaped steel profile with a wooden beam sliding therein and forming the adjustment member 28.

The bent 2 further comprises a lifting device 29 operating between the holder 26 and the first beam portion 17 for adjusting the level of the holder 26. In the embodiment of FIGS. 1-9, the lifting device 29 comprises two lifting screws 30 spaced at a distance from each other. The holder 26 rests on the upper end of both of the lifting screws 30. The lifting screw 30 extends through a hole 31 in the first beam portion 17. The lifting screw can be tightened and locked in position by locking nuts 32.

FIG. 13 shows an alternative lifting device 29, a mechanical jack described herein in an exemplifying fashion and known from the context of vehicles. The jack 29 may as well be hydraulic.

Figure 5:
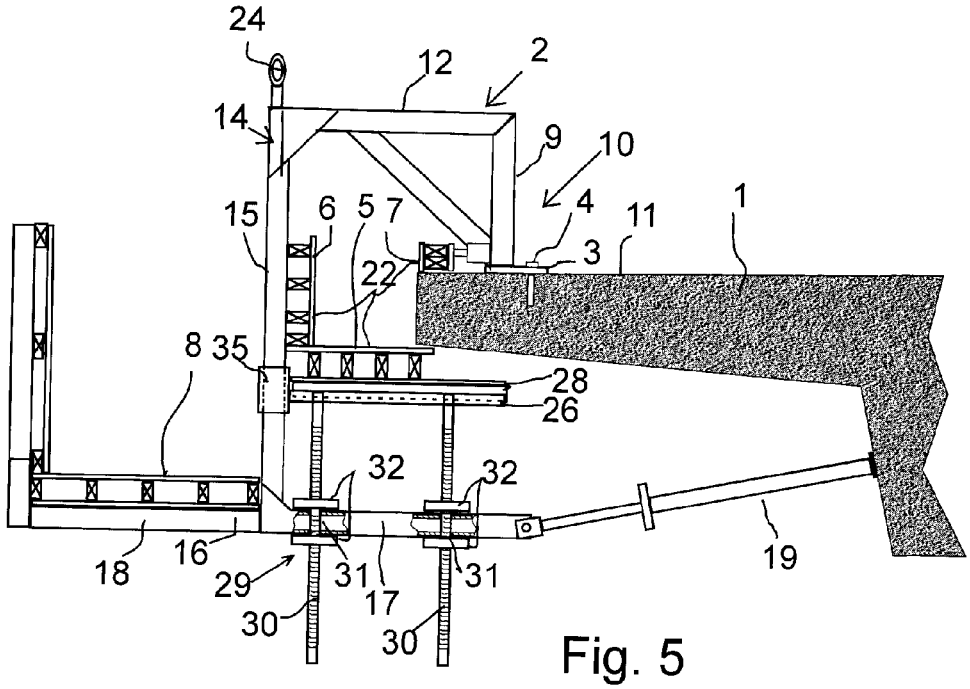
Figure 6:
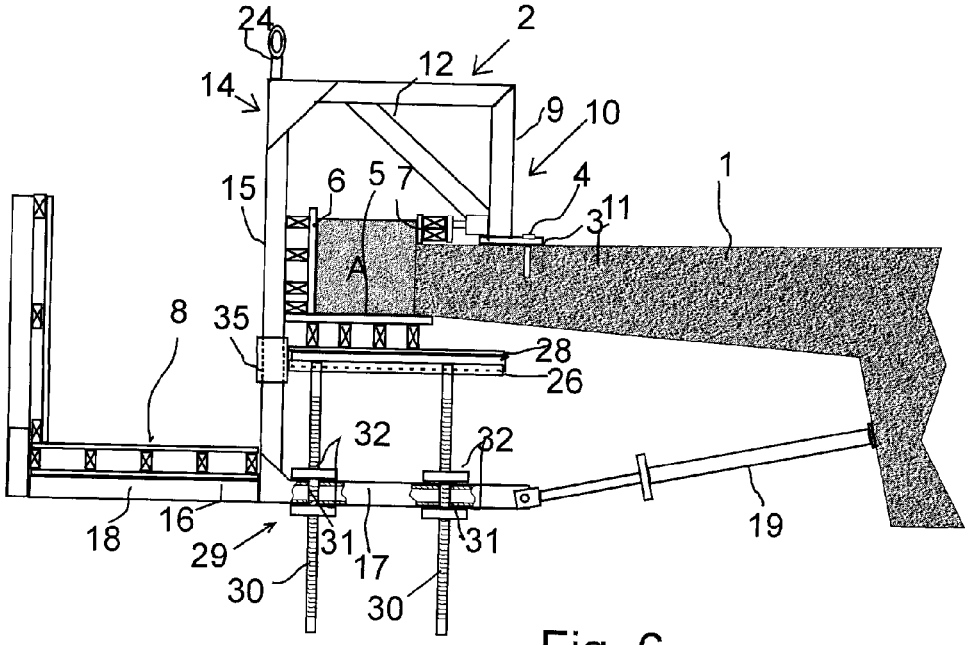

As seen from FIGS. 5 and 6, the mould walls 5, 6, 7 comprise a horizontal mould wall 5 which limits the casting in a downward direction, and two vertical mould walls 6, 7 which limit the casting in lateral directions. The first vertical mould wall 6 limits the casting in a first lateral direction, and the second vertical mould wall 7 limits the casting in a second lateral direction which is an opposite direction relative to the first lateral direction.

FIG. 11 shows an embodiment which corresponds with that described in the context of FIGS. 1-9, except that the upper horizontal beam 12 is longer. Furthermore, a vertical support 33 is supported to move horizontally in the guidance of the upper horizontal beam 12. The second vertical mould wall 7 is supported onto the vertical support 33. The vertical support may be detachably locked in position by means of locking members 34. At the upper end of the vertical support 33 there is a second sliding sleeve 36 which cooperates with the outer surface of the upper horizontal beam 12 in guiding the vertical support 33 to move horizontally.

In the following section, the different steps of the method according to the invention will be described with reference to FIGS. 1-10.

In FIG. 1, the bent 2 is moved to its position to the edge of the bridge that needs to be repaired by lifting it in a tilted position by the suspension member 24 in such manner that the edge of the bridge is set between the mounting flange 3 and the holder 26. Thanks to the location of the suspension member 24 relative to the mass centre, the bent 2 assumes this position automatically when it is hanging freely. The tilted bent 2 is lowered so that the mounting flange 3 comes into contact with the upper surface 11 of the bridge. The bent 2 is lowered further so that the mounting flange 3 becomes aligned with the upper surface 11 of the bridge as shown in FIG. 2.

In accordance with FIG. 2, the mounting flanges 3 at the lower ends 10 of the vertical beams 9 of the bents 2 are secured by the anchor bolts 4 to the upper surface 11 of the bridge to a distance from the edge of the bridge that needs to be repaired. When securing the mounting flange 3 to the upper surface 11 of the bridge, the position of the bent 2 is adjusted by placing steel wedges between the mounting flange 3 and the upper surface 11 of the bridge, because the upper surface of the bridge is often uneven and rarely completely horizontal. Furthermore, the bents 2 are supported onto the lower surface of the bridge by the longitudinally adjustable support bars 19.

Figure 3:
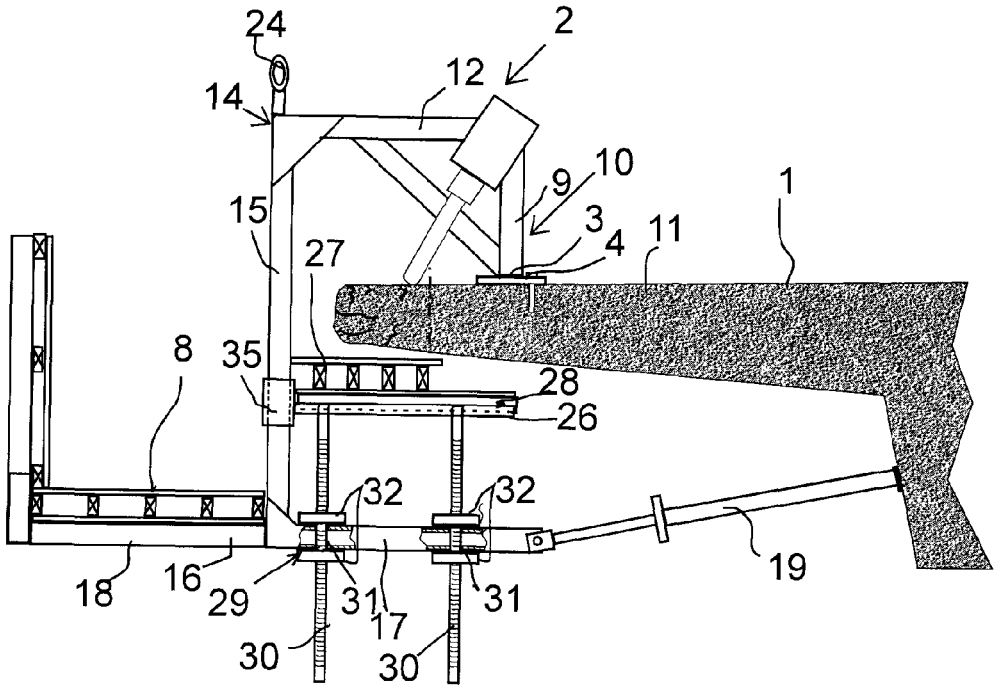
Figure 4:
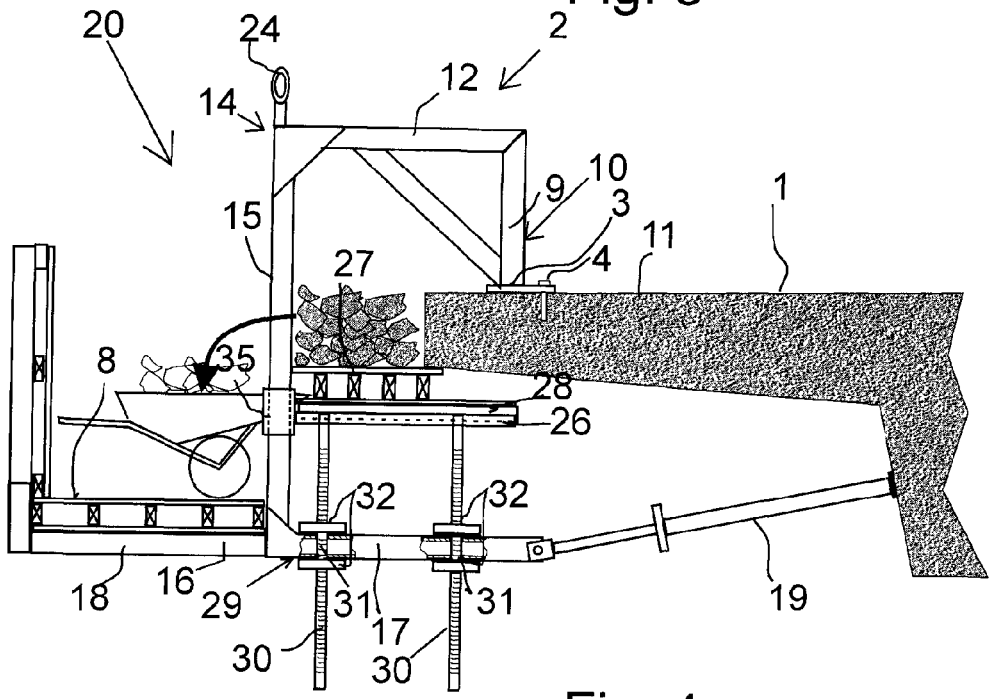

FIG. 3 shows that next, the access bridge elements 8 are arranged onto the second beam portion of the lower horizontal beam 16. The receiving member 27 is arranged onto the holders 26 for receiving the rubble. The holders 26 are lifted by the lifting device 29 in such manner that the receiving member 27 comes close to and under the edge of the bridge that needs to be repaired. Old concrete is removed from the edge of the bridge over the area to be renewed, and the rubble is received onto the receiving member 27 as illustrated in FIG. 4. The rubble is removed from the receiving member 27 for example into a wheel-barrow and is carried away along the access bridge 8.

FIG. 5 shows that the horizontal mould wall 5 and the first vertical mould wall 6 are supported onto the holders 26. Furthermore, there is the second vertical mould wall 7. The edge of the horizontal mould wall 5 is positioned tightly against the lower surface of the bridge and the first vertical mould wall 6 is supported against the vertical columns 15, its lower end resting tightly against the horizontal mould wall 5. The first vertical mould wall 6 is placed at a distance from the remaining edge of the bridge after the old concrete has been removed.

In FIG. 6, a new edge beam A or other edge extension is cast from concrete into the space bounded by the first vertical mould wall 6, the horizontal mould wall 5 and the second vertical mould wall 7, and the remaining edge of the bridge after the removal of the old concrete.

Figure 7:
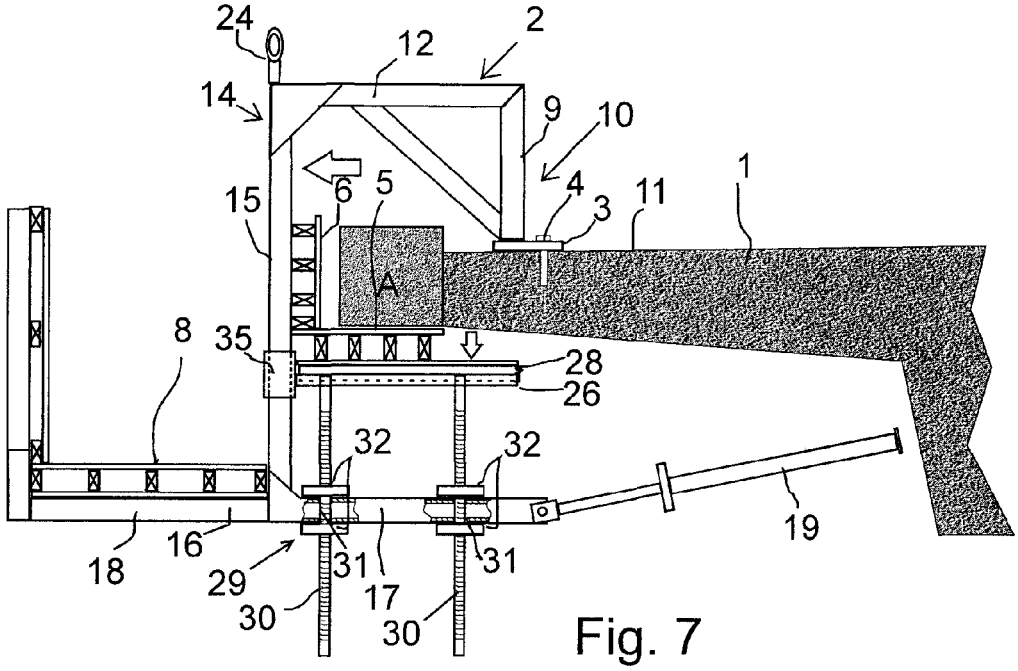

FIGS. 7 and 8 show that after the cast concrete has hardened, the holders 26 are slightly lowered by the lifting device 29 so that the horizontal mould wall 5 is detached from the lower surface of the cast edge beam or other extension. The support bars 19 are then loosened. The anchor bolts 4 are loosened so that the mounting flange 3 can be moved horizontally relative to the upper surface 11 of the bridge. The bents 2 are moved for a couple of centimetres, for example by striking them, transversely relative to the longitudinal direction of the bridge within the limits set by the long holes 23 of the mounting flange 3 so that the first vertical mould wall 6 is detached from the cast edge beam A or other extension.

Then, in accordance with FIG. 8, the holders 26 are lowered by the lifting device in order to detach the horizontal mould wall 5 from the cast edge beam or other extension. After this, the vertical mould walls 6 can be removed. The holders 26 are lowered by the lifting device 29 and the horizontal mould wall 5 is removed from the holders 26. The access bridge 8 is removed from the bents 2.

Then, in accordance with FIG. 9, the anchor bolts 4 are removed in order to remove the bents 2 one at a time, and the bent 2 is moved away from the edge of the repaired bridge by grabbing again the suspension members 24 and lifting the bent 2 away from the edge of the bridge. The bents 2 are ready for instant reuse in another repair location.

FIG. 12 shows an alternative manner of supporting the vertical beam 9 of the bent 2 onto the bridge. A non-thorough recess hole 37 is drilled into the upper surface of the bridge in order to insert the lower end of the vertical beam 9 therein. Soldering concrete 38 is cast into the recess hole around the vertical beam in order to fixedly secure the bent onto the deck of the bridge.

FIG. 14 shows yet one embodiment of a situation corresponding to the situation of FIG. 2 during mounting of the bent to its position. The vertical support 33 is here fixedly secured to the upper horizontal beam 12 at a distance from the vertical beam 9. The vertical support 33 operates as a supporting foot supported onto the deck of the bridge, by which the bent 2 can stand stably in the position of FIG. 14 when the support bar 19 is being placed against the lower surface of the bridge. In another embodiment, the vertical support 33 operating as the supporting foot may be adapted to move horizontally in the guidance of the upper horizontal beam 12, and it comprises locking members 34 for detachably locking it to its position in the manner similar to that described with reference to FIG. 11.

The invention is not limited merely to the exemplifying embodiments referred to above; instead many variations are possible within the scope of the inventive idea defined by the claims.

The invention claimed is:

1. A scaffold arrangement for repairing the edge structure of a concrete bridge, the arrangement comprising:

a number of bents arranged at a distance from each other over a portion of the length of the bridge that needs to be repaired and supported onto the edge of the bridge, comprising support members for supporting the bent onto the bridge, mould walls supported onto the bents in order to form a concrete casting mould for casting a new edge structure for the bridge, and an access bridge supported onto the bents in order to form a passage and a working platform for the duration of the repair period, wherein the bent comprises:

a first beam portion extending substantially transversely relative to the longitudinal direction of the bridge to a distance below the bridge, so that said mould walls can be fitted onto the first beam portion, a second beam portion extending to an opposite direction relative to the first beam portion and supporting the access bridge, and a longitudinally adjustable support bar pivotally connected at one end to the first beam portion and being at the other end supportable against the lower surface of the bridge.

2. The arrangement according to claim 1, wherein the bent further comprises:

a vertical beam which is substantially vertical and in which vertical beam the lower end can be anchored to the upper surface of the bridge by said support members to a distance from the edge of the bridge that needs to be repaired, the vertical beam extending to a distance above the upper surface of the bridge, an upper horizontal beam in which the first end is rigidly secured to the upper end of the vertical beam, the horizontal beam extending from the vertical beam substantially horizontally and substantially transversely relative to the longitudinal direction of the bridge in such manner that the second end of the upper horizontal beam extends over the edge of the bridge to a distance from the edge of the bridge, and a vertical column, secured vertically at the upper end to the second end of the upper horizontal beam, the lower end of the vertical column extending to a distance down from the edge of the bridge, and lower horizontal steel beam secured rigidly to the vertical column and extending from the vertical column substantially horizontally and substantially transversely relative to the longitudinal direction of the bridge.

3. The arrangement according to claim 2, wherein the lower horizontal beam comprises the said first beam portion and said second portion which extend from the vertical column.

4. The arrangement according to claim 2, wherein any of the vertical beam, the horizontal beam and the vertical column is made of steel.

5. The arrangement according to claim 2, wherein in that rigidly secured to the lower end of the vertical beam is a mounting flange comprising long holes which extend substantially transversely relative to the longitudinal direction of the bridge, so that anchor bolts can be secured through the long holes to the bridge.

6. The arrangement according to claim 2, wherein the bent comprises a suspension member which can be grabbed by a grabbing member of a lifting device, such as a lifting hook, and which suspension member is arranged to be offset from the mass centre of the bent, so that when lifted by the suspension members, the bents are tilted in such manner that during mounting of the bents, the mounting flange is first supported at the edge to the upper surface of the bridge at a contact point, and as the bent is lowered further the mounting flange turns about said contact point until it is in alignment with the upper surface and rests against it.

7. The arrangement according to claim 1, wherein each bent comprises a holder, the level of which can be vertically adjusted, and that the mould walls can be supported onto the holders.

8. The arrangement according to claim 7, wherein the holder comprises an adjustment member for moving the mould walls horizontally.

9. The arrangement according to claim 1, wherein the mould walls comprise at least one horizontal mould wall limiting the casting in a downward direction and at least one vertical mould wall limiting the casting in a lateral direction.

10. The arrangement according to claim 2, wherein the bent comprises a vertical support connected to the upper horizontal beam to a distance from the vertical beam and adapted to operate as a supporting foot for the bent during mounting.

11. The arrangement according to claim 10, wherein the second vertical mould wall is connected to the vertical support.

12. A method for repairing the edge structure of a concrete bridge, in which method the scaffold arrangement according to claim 1 is mounted to the edge of the bridge, the scaffold arrangement comprising bents at a distance from each other over the length of the bridge, the bents comprising support members for supporting the bent onto the bridge, mould walls are supported onto the bents in order to form a concrete casting mould for casting a new edge structure, and an access bridge forming a passage for the duration of the repair period is formed onto the bents, and in which method the scaffold arrangement is supported onto the lower surface of the bridge by longitudinally adjustable support bars, wherein the bents are fixedly anchored by the support members to the upper surface of the bridge to a distance from the edge of the bridge that needs to be repaired.

13. The method according to claim 12, wherein the bent is moved to its position to the edge of the bridge that needs to be repaired by lifting it in a tilted position by suspension members in such manner that the edge of the bridge is set between mounting flanges and holders, the tilted bent is lowered so that the mounting flange comes into contact with the upper surface of the bridge, the bent is lowered further so that the mounting flange becomes aligned with the upper surface of the bridge, the mounting flange is secured by anchor bolts to the upper surface of the bridge, and the bent is supported onto the lower surface of the bridge by the longitudinally adjustable support bars.

14. The method according to claim 13, wherein in securing the mounting flange to the upper surface of the bridge, the position of the bent is adjusted by placing wedges between the mounting flange and the upper surface of the bridge.

15. The method according to claim 12, wherein a horizontal mould wall and a first vertical mould wall are supported onto the holders, and optionally a second vertical mould wall is also supported onto a vertical support, the edge of the horizontal mould wall is positioned tightly against the lower surface of the bridge, the first vertical mould wall is supported against vertical columns and, at the lower end, tightly against the horizontal mould wall, and it is moved horizontally to a distance from the remaining edge of the bridge after the removal of the old concrete, optionally, a vertical support is adjusted horizontally in order to position the second vertical mould wall, and it is locked in position by locking means, and the new edge beam or other edge extension is cast from concrete into the space bounded by the first vertical mould wall, the horizontal mould wall, the optional second vertical mould wall and the remaining edge of the bridge after the removal of the old concrete.

16. The method according to claim 15, wherein after hardening of the cast concrete holders are lowered by the lifting device in order to detach the horizontal mould wall from the cast edge beam or other extension, support bars are loosened, anchor bolts are loosened so that the mounting flange can be moved horizontally relative to the upper surface of the bridge, optionally, the second vertical mould wall is moved off from the cast edge beam by moving the vertical support, and the bents are moved transversely relative to the longitudinal direction of the bridge within the limits set by long holes of the mounting flange in order to detach the first vertical mould wall from the cast edge beam or other extension.

17. The method according to claim 16, wherein the vertical mould walls are removed, holders are lowered by the lifting device and the horizontal mould wall is removed from the holders, the access bridge is removed from the bents, the support members, such as the anchor bolts are removed, and the bents are moved away from the edge of the repaired bridge by grabbing suspension members and lifting the bents away from the edge of the bridge.

18. A scaffold arrangement for repairing the edge structure of a concrete bridge, the arrangement comprising:

a number of bents arranged at a distance from each other over a portion of the length of the bridge that needs to be repaired and supported onto the edge of the bridge, comprising support members for supporting the bent onto the bridge, mould walls supported onto the bents in order to form a concrete casting mould for casting a new edge structure for the bridge, and an access bridge supported onto the bents in order to form a passage and a working platform for the duration of the repair period, wherein the bent comprises:

a vertical steel beam which is substantially vertical and in which vertical beam the lower end can be anchored to the upper surface of the bridge by said support members to a distance from the edge of the bridge that needs to be repaired, the vertical beam extending to a distance above the upper surface of the bridge, an upper horizontal steel beam in which the first end is rigidly secured to the upper end of the vertical beam, the horizontal beam extending from the vertical beam substantially horizontally and substantially transversely relative to the longitudinal direction of the bridge in such manner that the second end of the upper horizontal beam extends over the edge of the bridge to a distance from the edge of the bridge, a vertical steel column, secured vertically at the upper end to the second end of the upper horizontal beam, the lower end of the vertical column extending to a distance down from the edge of the bridge, and a lower horizontal steel beam secured rigidly to the vertical column and extending from the vertical column substantially horizontally and substantially transversely relative to the longitudinal direction of the bridge, the lower horizontal beam comprising:

a first beam portion extending from the vertical column to a distance below the bridge, so that said mould walls can be fitted onto the first beam portion, and a second beam portion extending from the vertical column to an opposite direction relative to the first beam portion and supporting the access bridge, and a longitudinally adjustable support bar pivotally connected at one end to the first beam portion and being at the other end supportable against the lower surface of the bridge.

19. A method for repairing the edge structure of a concrete bridge, in which method the scaffold arrangement according to claim 18 is mounted to the edge of the bridge, the scaffold arrangement comprising bents at a distance from each other over the length of the bridge, the bents comprising support members for supporting the bent onto the bridge, mould walls are supported onto the bents in order to form a concrete casting mould for casting a new edge structure, and an access bridge forming a passage for the duration of the repair period is formed onto the bents, and in which method the scaffold arrangement is supported onto the lower surface of the bridge by longitudinally adjustable support bars, wherein the lower ends of vertical beams of the bents are fixedly anchored by the support members to the upper surface of the bridge to a distance from the edge of the bridge that needs to be repaired.

* * * * *